United States Patent [19]

Taylor

[11] 4,390,199

[45] Jun. 28, 1983

[54] LATCH AND LOCK GUARD

[75] Inventor: William H. Taylor, Owen Sound, Canada

[73] Assignee: Hutch Protective Devices Ltd., Owen Sound, Canada

[21] Appl. No.: 257,270

[22] Filed: Apr. 24, 1981

[51] Int. Cl.[3] ..... E05C 21/00

[52] U.S. Cl. ..... 292/346

[58] Field of Search ..... 292/340, 346

[56] References Cited

U.S. PATENT DOCUMENTS

| | | | |
|---|---|---|---|
| 1,373,678 | 4/1921 | Siemer | 292/346 X |
| 2,144,075 | 1/1939 | Mora | 292/346 |
| 2,454,904 | 11/1948 | Wylie | 292/346 |
| 3,592,498 | 7/1971 | Racuglia, Sr. | 292/346 |
| 3,895,834 | 7/1975 | Grinbaum et al. | 292/346 |
| 3,963,269 | 6/1976 | Rosenberg | 292/346 |

FOREIGN PATENT DOCUMENTS

| | | |
|---|---|---|
| 1055547 | 5/1979 | Canada . |
| 1082249 | 7/1980 | Canada . |

*Primary Examiner*—Richard E. Moore

*Attorney, Agent, or Firm*—Burke, Robertson, Chadwick & Ritchie

[57] ABSTRACT

A latch and lock guard for doors which comprises a pair of similar elongated bars of sufficient width and thickness for purposes of rigidity. Each bar has a flat base and a series of uniform, regularly spaced teeth extending integrally from the bar sideways along one edge. The width of the spaces between the teeth is slightly greater than the width of the teeth. Means are provided to secure solidly one bar to the external side of a door over the lock area, with its teeth pointing towards the adjacent door edge, and to secure solidly the other bar to the door jamb with its teeth pointing towards the door edge, the teeth of one bar fitting within the slots between the teeth of the other, and vice versa, in interlocking fashion when the door is in closed position. Such a latch and lock guard provides a very strong, but simple and easily installed device for protecting a door against jimmying in a direct face attack, for example, through use of a credit card or sharp pointed device, or in a vertical attack by prying the door from underneath or above.

9 Claims, 6 Drawing Figures

LATCH AND LOCK GUARD

BACKGROUND OF THE INVENTION

This invention relates to a device for protecting against jimmying of a door lock, and more particularly relates to a latch and lock guard to be secured externally to a door and door jamb to prevent or make more difficult illegal entry through that door.

It is well known that illegal entry into a door is often achieved by a burglar by sliding a plastic credit card or thin flat spring steel band into the latch and lock area of the door to release the latch or lock, or latch buttons. Alternatively, illegal entry into a door is oftentimes achieved by prying the door with a screwdriver or a wrecking bar with a sharpened point either in a vertical way, by prying under the door to lift the door and spring the lock, or by attacking the latch and lock directly to release it.

There have been numerous prior art proposals for anti-jimmy guards for doors. Typical of these is that described in Raccuglia U.S. Pat. No. 3,592,498 issued July 13, 1971, having a U-shaped bracket mounted on the inside surface of a door jamb to receive the extension of an L-shaped bracket mounted on the front of the door. When the door is in closed position, the screws holding the brackets in place are covered by the other bracket. While this device appears effective to prevent jimmying of the door with a credit card or the like, it does not appear intended to prevent jimmying of a door in a vertical direction. As well, when the door is in open position, the L-shaped bracket protrudes into the passage area.

Grinbaum U.S. Pat. No. 3,895,834 issued July 22, 1975, describes and illustrates a guard for a door employing a female member which mates with a male member, the members being secured to the door jamb and door respectively. The female member is an elongated bracket defining in cross-section the shape of an L with longitudinally spaced slots extending transversely through both surfaces defining the L. The male member is elongated and flat with longitudinally spaced elements extending across and engageable with the corresponding slots of the female member, each element defining a portion of a flat circular disc. The device in application requires mortising of the jamb to which the female member is secured, and carving in the jamb appropriate slots for receiving the elements of the male member. Thus, alignment of the two members is such that a skilled carpenter or cabinet maker would normally be required.

Wylie U.S. Pat. No. 2,454,904 issued Nov. 30, 1948 describes and illustrates a plate-like door lock protector again requiring mortising of the door and door jamb to which it is secured.

Other patents of general background interest are Canadian Pat. No. 1,055,547 of Rosenberg issued May 29, 1979; Canadian Pat. No. 1,082,249 of Rosenberg issued July 22, 1980; U.S. Pat. No. 3,271,063 of Garrett issued Sept. 6, 1966; U.S. Pat. No. 3,826,526 of Wepsala Jr. issued July 30, 1974; U.S. Pat. No. 3,761,119 of Bennett et al issued Sept. 25, 1973; U.S. Pat. No. 3,764,173 of Griffith issued Oct. 9, 1973; U.S. Pat. No. 4,178,027 of Charron issued Dec. 11, 1979; U.S. Pat. No. 2,484,024 of Garberding issued Oct. 11, 1949; U.S. Pat. No. 1,373,678 of Seimer issued Apr. 5, 1921 and Canadian Pat. No. 979,051 of Nemitz issued Dec. 2, 1975, all of these references describing various proposals for door lock or latch protectors.

It is an object of the present invention to provide a latch and lock guard for a door which is relatively easily manufactured and simple to install. It is a further object to provide such a device that may be easily installed on the outside of a door without mortising, and which will provide resistance against jimmying from the door in a direct face attack or in a vertical attack.

SUMMARY OF THE INVENTION

According to the present invention a latch and lock guard for doors is provided which comprises a pair of similar elongated bars of sufficient width and thickness for purposes of rigidity. Each bar has a flat base and a series of uniform, regularly spaced teeth extending integrally from the bar sideways along one edge. The width of the spaces between the teeth is slightly greater than the width of the teeth. Means are provided to secure solidly one bar to the external side of a door over the lock area, with its teeth pointing towards the adjacent door edge, and to secure solidly the other bar to the door jamb, with its teeth pointing towards the door edge, the teeth of one bar to fit within the slots between the teeth of the other, and vice versa, in interlocking fashion when the door is in closed position.

The bars are secured in place, one on the exterior face of the door along its edge in the vicinity of the latch or lock to be protected by means of smooth-headed bolts passing through holes in the bar and the door and secured to the door with nuts on the inside of the door, and the other to the jamb with anti-theft wood screws (i.e. screws which have been adapted normally to turn only in the direction necessary for insertion) through appropriate spaced holes in the bar. Such anti-theft wood screws may also complement the bolts securing the bar to the door. The bars are made of appropriate solid thick non-corrosive material.

The device according to the present invention is easy to make, the two bars being of identical construction. It is easily installed, requiring no mortising, and sits on the door and jamb so as to provide minimum obstruction to the passageway. When in position, when the teeth of the bars are meshed between each other in interlocking fashion, the device prevents anything such as a credit card or flexible band being inserted into the lock area by a burglar in a direct face attack, or relative vertical movement of the door and door frame by prying the door up from underneath or down from above in a vertical attack. The device itself is extremely difficult to dislodge by a burglar, because of the manner in which it is secured to the door and door jamb. As well, when in place, the device permits opening and closing of the door freely, without the danger of jambing or getting stuck in a closed position. These features make the guard device practical for example for use on hotel room doors or residential home doors.

BRIEF DESCRIPTION OF THE DRAWINGS

Other objects and advantages of the present invention will become apparent upon reading the following detailed description and upon referring to the drawings in which.

Figure 1:
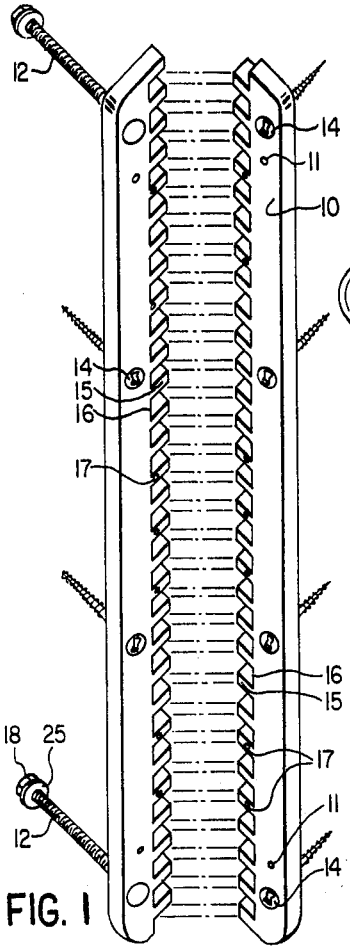
FIG. 1 is a perspective view of an example embodiment of a latch and lock guard according to the present invention.

While the invention will be described in connection with an example embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE INVENTION

In the following description, similar features have been given similar reference numerals.

Figure 4:
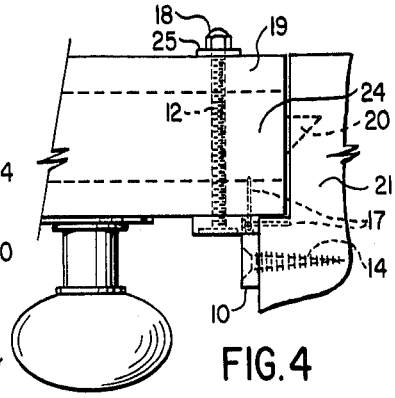
FIGS. 4 and 5 are end views of a door and door jamb through which a latch and lock guard according to the present invention has been secured, respectively in closed and open positions.

Turning to FIG. 1, there is shown a latch and lock guard according to the present invention comprising a pair of similar, elongated bars 10 of sufficient width and thickness for purposes of rigidity. The bars are flat on both rear and front sides. A series of uniform, regularly spaced teeth 15 extend from each bar 10 sideways along one edge, the width of the spaces 16 between the teeth being slightly greater than the width of the teeth themselves. It will be noted that bars 10 are of the same design but, in FIG. 1, one of the bars is turned 180 degrees so that the lower slot of one becomes the upper slot of the other and the top tooth of one becomes the lower tooth of the other. Slots 16 are narrow enough to prevent the insertion of any tool that would be strong enough to jimmy the guard. They are slightly larger than teeth 15 to allow easy meshing of the teeth of the bars as will be described subsequently, in interlocking fashion when the guard is in place and the door is in closed position as shown in FIG. 4. In the preferred embodiment, the thickness and length of the teeth 15 correspond more or less to the thickness of bars 10.

Figure 6:
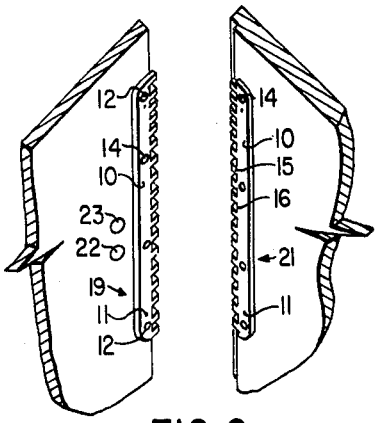
FIG. 6 is a perspective view of a door and door jamb, to which a latch and lock guard according to the present invention has been secured, in open position.

Locating holes 11 are provided in bars 10 for insertion of a finishing nail in each to act as positioning pins when mounting the bars on door 19 and door jamb 21 (FIG. 6). These holes permit the bars to be held in their proper place so that they may affixed to the door and jamb in exact locations. Should an error be made the bars then can easily be pulled off and repositioned again.

Figure 2:
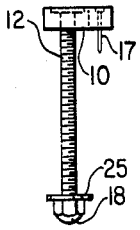
FIGS. 2 and 3 are top views of a bar according to the present invention for securing respectively to a door and to a jamb.
Figure 3:
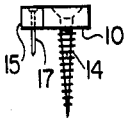

As can be seen in FIGS. 1, 2 and 3, bars 10 are secured in place by means of appropriate bolts 12, anti-theft head screw nails 14, fine wood screws or finishing nails 17. Acorn nuts 18 and washers 25 are used with bolts 12 on bar 10 which is secured to door 19 to hold the bolts from the inside of the door. Bolts 12 are strong heavy anti-corrosive (e.g. stainless steel) bolts with flat anti-theft heads, which bolts pass right through the door (FIGS. 4 or 5) and are held inside the door with washers 25 and acorn nuts 18, well back from the edge of the door. Anti-theft head screw nails 14, which permit turning of the screws for insertion, but the heads of which have been constructed so as to make difficult or impossible turning of the screw to retract it once in position, are also used as illustrated in FIG. 1 for securing door bar 10 and jamb bar 10 in position. Appropriate holes through bar 10, countersunk so that the heads of the screws and bolts will be reasonably flush with the front face of each corresponding bar 10. Similarly, small holes are provided in teeth 15, as shown, to receive flushly fine wood screws or finishing nails 17. These hold the teeth tight to the door and also prevent and act as a barrier against steel flat feelers being slid under the bar to attack the lock.

As shown schematically in FIG. 6, bars 10 are mounted with one secured to the exterior face of the door, one bolt 12 being above lock 24 (FIGS. 4 and 5) and cylinder lock 23 for the key and the other being below. (The guard of FIG. 6 is not drawn to scale, as it will be observed that in practice a bar of 24 centimeters length and 6 millimeters width has proven effective for the purposes intended). The relative thickness of the bar compared to its width can be seen from FIGS. 2 and 3, although the invention is not to be restricted to this actual size or proportion.

Figure 5:
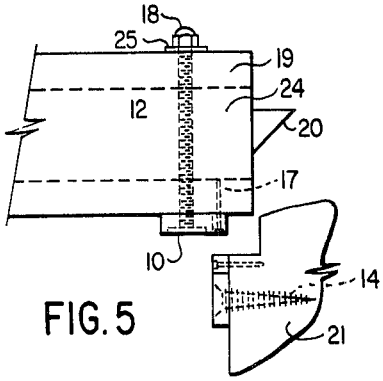

Bars 10 are mounted as shown in FIGS. 4 to 6, with teeth and slots of the bar 10 mounted to the door facing the door edge next to the jamb, and the teeth and slots of the bar 10 mounted to the jamb facing the bar on the door, so that when the door is closed (FIG. 4) teeth 15 of the door bar 10 fit within the slots 16 between the teeth of the jamb bar 10 in interlocking fashion, and vice versa. It will be noted that when the door is in closed position, the planes of bar 10 are in a 90 degree relationship to each other.

From the foregoing, the simplicity of construction and ease of installation of the device according to the present invention can be readily understood. No mortising or carpentry work on the door or jamb, other than the drilling of holes in the door for bolts 12 and possibly the drilling of starter holes in the door and jamb bar screw nails 14, is required for mounting bars 10, since they are mounted right on the exterior surfaces of door and jamb. When the door is in open position (FIG. 5), the guard device according to the present invention provides virtually no obstruction to the passage space between the door and door jamb. When the door is in closed position (FIG. 4), because of the meshing or interlocking of teeth 15 of bars 10 in slots 16, flat steel feelers or bands, credit cards or the like cannot be slid between the jamb bars to release the latch buttons or latch of the door lock. Nor can such devices be slid under the bars for this purpose because of the bolts, screws and finishing nails which secure the bars in place. It will be observed from FIG. 4, additionally, that when the door is in closed position, the main body portion of each bar 10 completely obscures from view wood screws or finishing nails 17 which are positioned in the holes through the teeth, again constituting a security feature of the device. The intermeshing of teeth 15 of one bar 10 in slots 16 of the other bar 10, when the door is in closed position as shown in FIG. 4 makes the door and door jamb relatively secure against jimmying from a vertical attack, i.e. by prying the door up from underneath or down from above to achieve relative movement of door and door jamb to spring the lock. As previously indicated, furthermore, the door on which such a device is mounted may be opened and closed freely without the need for releasing any further latch or lock and without the danger of getting stuck in a closed position.

Thus it is apparent that there has been provided in accordance with the invention a latch and lock guard for doors that fully satisfies the objects, aims and advantages set forth above. While the invention has been described in conjunction with an example embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What I claim as my invention:

1. A latch and lock guard for doors comprising a pair of similar elongated bars of sufficient width and thickness for purposes of rigidity, each bar having a flat base, a series of uniform, regularly spaced teeth extending integrally from the bar sideways along one edge, the width of the spaces between the teeth being slightly greater than the width of the teeth, means to secure solidly one bar to the external side of a door over the lock area with its teeth pointing towards the adjacent door edge, and means to secure solidly the other bar to the door jamb with its teeth pointing towards the door edge, the teeth of one bar to fit within the slots between the teeth of the other, and vice versa in interlocking fashion when the door is in closed position.

2. A guard according to claim 1 wherein the thickness of the teeth corresponds to the thickness of the bar.

3. A guard according to claim 1 or 2 wherein the length of the teeth corresponds to the thickness of the bar.

4. A guard according to claim 1 wherein the bars are flat on both sides so that either side of each bar may be used as the base.

5. A guard according to claim 1 wherein each bar is provided with spaced holes, the axes of which are normal to the base to receive screws or bolts.

6. A guard according to claim 5 further provided with anti-theft, smooth-headed bolts, each to pass through a hole in the bar to be secured to the door, each of the bolts being of sufficient length to pass through the door when seated in securing position in the bar, each of the bolts further provided with nut means for securing the bolt in position in the bar and door.

7. A guard according to claim 5 or 6 having anti-theft wood screws to pass through the spaced holes in the bars for securing the bars to the door and the jamb.

8. A guard according to claim 1 or 5 further provided with holes passing through the thickness of a plurality of teeth, such holes to receive small screws or finishing nails for further securing the bars in place on the door or jamb, these holes being completely covered by the other bar when the teeth of the bars are meshed in interlocking fashion when the door is in closed position.

9. A guard according to claim 1 further provided with spaced alignment holes extending through each bar in a direction normal to its base.

* * * * *